US011629731B2

(12) United States Patent
Ahmed

(10) Patent No.: US 11,629,731 B2
(45) Date of Patent: Apr. 18, 2023

(54) THERMO-ELECTRIC COOLER PUMP METHODS AND SYSTEMS

(71) Applicant: Faizan Ahmed, San Jose, CA (US)

(72) Inventor: Faizan Ahmed, San Jose, CA (US)

( * ) Notice: Subject to any disclaimer, the term of this patent is extended or adjusted under 35 U.S.C. 154(b) by 0 days.

(21) Appl. No.: 17/695,828

(22) Filed: Mar. 16, 2022

(65) Prior Publication Data

US 2022/0205688 A1 Jun. 30, 2022

Related U.S. Application Data

(63) Continuation of application No. 16/523,827, filed on Jul. 26, 2019.

(60) Provisional application No. 62/772,094, filed on Nov. 28, 2018.

(51) Int. Cl.
*F04D 29/58* (2006.01)
*F24F 5/00* (2006.01)

(52) U.S. Cl.
CPC ..... *F04D 29/586* (2013.01); *F24F 5/0042* (2013.01)

(58) Field of Classification Search
CPC .. F04D 29/5893; F04D 29/58; F04D 29/5873; F04D 1/00–3/02; F04D 7/00; F04D 7/02; F04D 13/16; F04D 13/02; F04D 13/06; F04D 29/586; F04D 29/5866; F04D 29/40–29/566; F04D 29/5853; F04D 29/5826; F24F 5/0042; F25B 21/02; F25B 21/04; F25B 2321/023; F25B 2321/0252
See application file for complete search history.

(56) References Cited

U.S. PATENT DOCUMENTS

| | | | | |
|---|---|---|---|---|
| 7,752,852 | B2 * | 7/2010 | Akei | F25B 1/00 62/115 |
| 7,866,164 | B2 * | 1/2011 | Rice | B60H 1/00478 62/259.3 |
| 8,989,566 | B2 * | 3/2015 | Liu | F04D 29/426 392/471 |
| 2003/0024565 | A1 * | 2/2003 | Guy | H01L 35/30 136/200 |
| 2014/0003976 | A1 * | 1/2014 | Hoj | H02K 11/33 417/410.1 |
| 2017/0082117 | A1 * | 3/2017 | Zhou | F04D 13/0686 |
| 2019/0063456 | A1 * | 2/2019 | Zoppas | F04D 15/0088 |

* cited by examiner

*Primary Examiner* — Bryan M Lettman

(57) ABSTRACT

A thermo-electric cooler pump system includes a liquid pump comprising a chiller/heater component and a case component. The case component seals a liquid so that the liquid does not enter the thermo-electric cooler pump system except by an inlet port and escape the thermo-electric cooler pump system except by an exit port. The system includes a motor component situated outside of the case component and not wetted by the liquid. A shaft of the motor component enters the case through a sealed hole. An impeller component is contained within the case component and attached to the shaft such that motion of motor component is transferred to the impeller component causing liquid to enter the inlet port and flow toward the exit port.

4 Claims, 4 Drawing Sheets

THERMO-ELECTRIC COOLER PUMP METHODS AND SYSTEMS

CLAIM OF PRIORITY

This application claims priority to and incorporates by reference U.S. Provisional Application No. 62/772,094, titled THERMO-ELECTRIC COOLER PUMP METHODS AND SYSTEMS, and filed on 28 Nov. 2018.

This application claims priority to U.S. patent application Ser. No. 16/134,192 filed on Sep. 18, 2018. U.S. patent application Ser. No. 16/134,192 claims priority to U.S. patent application Ser. No. 15/939,267 filed on Mar. 28, 2018. U.S. patent application Ser. No. 15/939,267 claims priority to U.S. provisional patent application No. 62/477,598 filed on 28 Mar. 2017. These patent applications are hereby incorporated by reference in their entirety.

BACKGROUND

Field of the Invention

The invention is in the field of refrigeration and more specifically to a method, system and apparatus of a thermo-electric cooler pump.

Description of the Related Art

Medicines and other products can degrade in certain conditions. For example, some temperatures need to be maintained in specified temperature ranges. Patients may not be able to constantly track medicine temperature. The same can be true for some testing instruments such as blood testing strips. Portable refrigerators can solve these issues. However, effective portable refrigerators need effective components that are sufficient. Accordingly, improvements to thermo-electric cooler pump design and use are desired.

BRIEF SUMMARY OF THE INVENTION

In one aspect, a thermo-electric cooler pump system includes a liquid pump. The liquid pump comprises an integrated chiller component and a heater component. The thermo-electric cooler pump system includes a case component. The case component seals a liquid with the thermo-electric cooler pump system so that the liquid does not enter the thermo-electric cooler pump system except by an inlet port and escape the thermo-electric cooler pump system except by an exit port. The system includes a motor component. The motor component is situated outside of the case component. The motor component is not wetted by the liquid. The shaft of the motor component enters the case through a sealed hole. The system includes an impeller component. The impeller component is contained within the case component, wherein the impeller is wetted by the liquid. The impeller component is attached to the shaft such that the motion of motor component is transferred to the impeller component causing it to move. The motion of impeller component causes the liquid to enter the inlet port and flow toward the exit port. The system includes a chiller/heater component. The chiller/heater component is fixed to case component. The chiller/heater component penetrates the case component such that a portion of the chiller/heater component is inside the case component and is wetted by the liquid while the other part of chiller/heater component is outside of the case component and is dry. There is a seal around the chiller/heater component so that liquid does not escape in a vicinity of the chiller/heater component. The chiller/heater component an electron flow to a thermal heat transfer by means of the Peltier effect.

Figure 1:
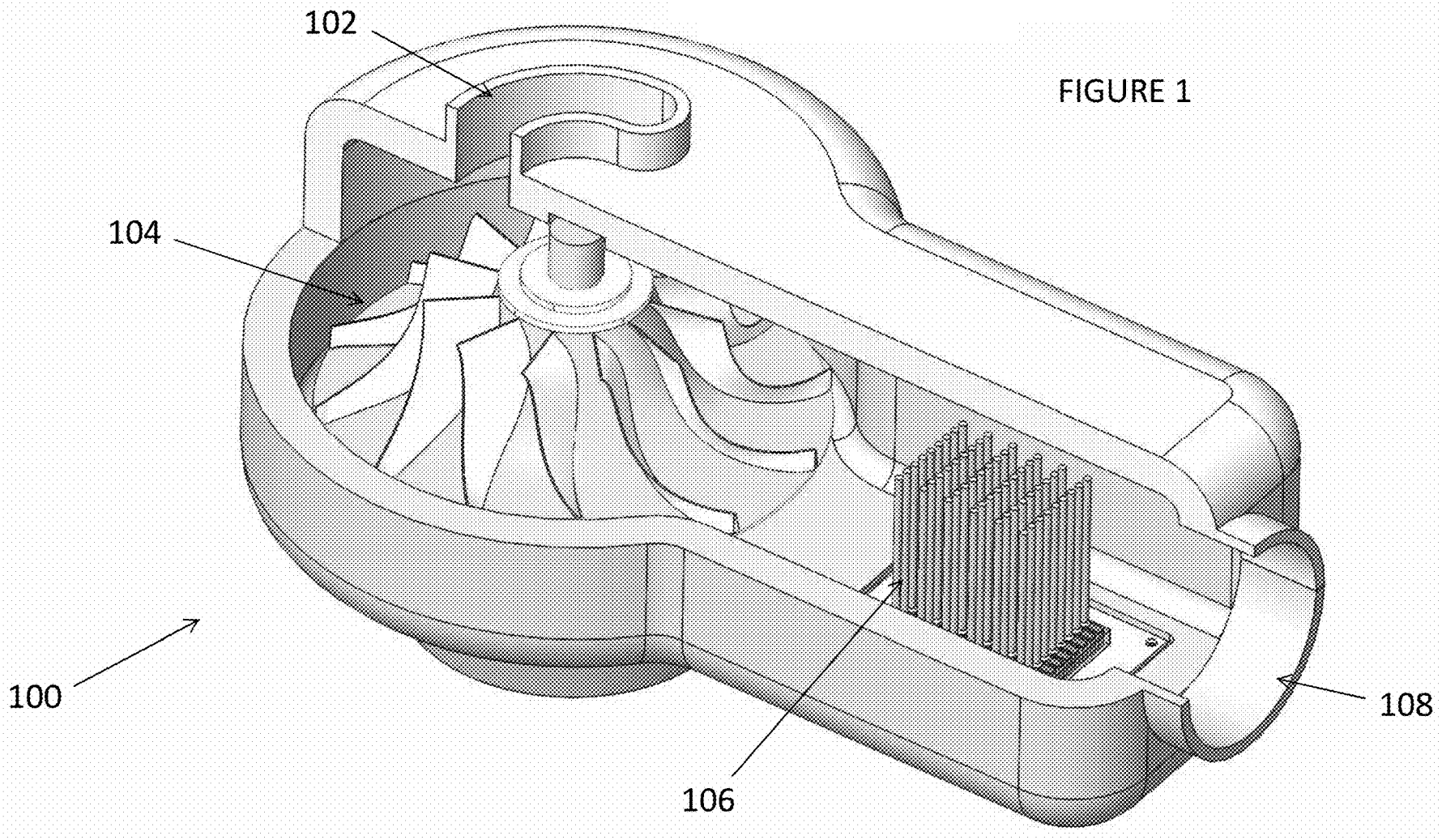
FIGS. 1-3 illustrate example views of a thermo-electric cooler pump, according to some embodiments.

The Figures described above are a representative set and are not an exhaustive with respect to embodying the invention.

DESCRIPTION

Disclosed are a system, method, and article of manufacture for a thermo-electric cooler pump. The following description is presented to enable a person of ordinary skill in the art to make and use the various embodiments. Descriptions of specific devices, techniques, and applications are provided only as examples. Various modifications to the examples described herein can be readily apparent to those of ordinary skill in the art, and the general principles defined herein may be applied to other examples and applications without departing from the spirit and scope of the various embodiments.

Reference throughout this specification to 'one embodiment,' 'an embodiment,' 'one example,' or similar language means that a particular feature, structure, or characteristic described in connection with the embodiment is included in at least one embodiment of the present invention. Thus, appearances of the phrases 'in one embodiment,' 'in an embodiment,' and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art can recognize, however, that the invention may be practiced without one or more of the specific details, or with other methods, components, materials, and so forth. In other instances, well-known structures, materials, or operations are not shown or described in detail to avoid obscuring aspects of the invention.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, and they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

Definitions

Example definitions for some embodiments are now provided.

The Peltier effect is the presence of heating or cooling at an electrified junction of two different conductors. When a current is made to flow through a junction between two conductors, A and B, heat may be generated or removed at the junction. Thermoelectric cooling uses the Peltier effect to create a heat flux between the junction of two different types of materials. A Peltier cooler, heater, or thermoelectric heat pump is a solid-state active heat pump which transfers heat from one side of the device to the other, with consumption of electrical energy, depending on the direction of the current.

Temperature sensors can include mechanical temperature sensors, electrical temperature sensors, integrated circuit sensors, medometers, etc.

Thermoelectric effect is the direct conversion of temperature differences to electric voltage and vice versa via a thermocouple. A thermoelectric device creates voltage when there are different temperatures on each side. Conversely, when a voltage is applied to it, heat is transferred from one side to the other, creating a temperature difference. At the atomic scale, an applied temperature gradient causes charge carriers in the material to diffuse from the hot side to the cold side.

Example Thermo-Electric Cooler Pump System

Figure 2:
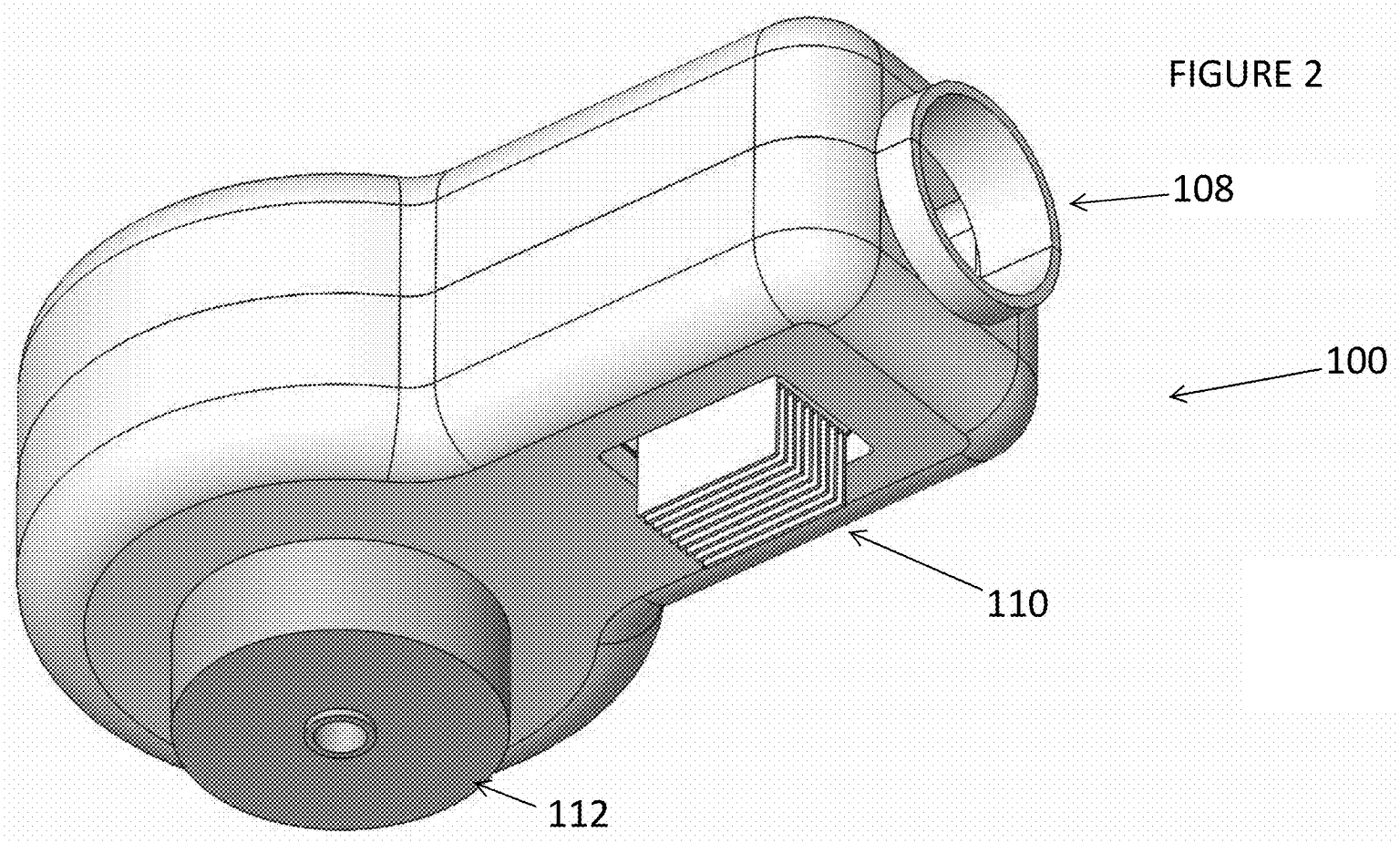
Figure 3:
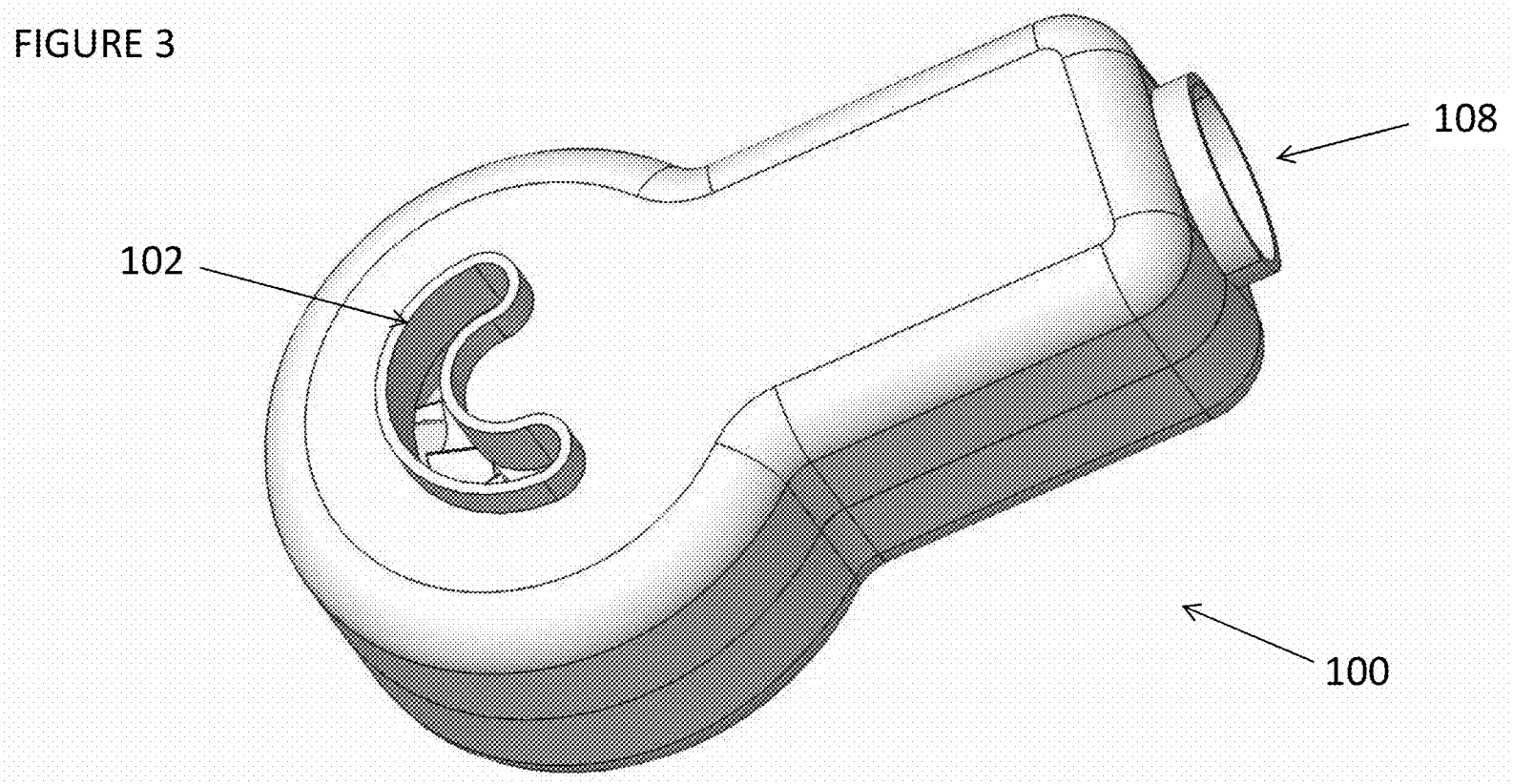

FIGS. 1-3 illustrate example view of a thermo-electric cooler pump system 100, according to some embodiments. More specifically, as shown in FIG. 1, thermo-electric cooler pump system 100 can include a liquid pump with integrated chiller and heater. Thermo-electric cooler pump system 100 can include inlet port 102. Thermo-electric cooler pump system 100 can include an impeller 104. Thermo-electric cooler pump system 100 can include a wetted side of heater and chiller 106 and exit port 108.

FIG. 2 illustrates the dry side of heater and chiller 110 of thermo-electric cooler pump system 100. Thermo-electric cooler pump system 100 includes a motor 112 as shown. FIG. 3 shown an additional view of thermo-electric cooler pump system 100 with inlet port 102.

More specifically, thermo-electric cooler pump system 100 can include a liquid pump with integrated chiller and heater. The liquid pump with integrated chiller includes four components. The case component seals the liquid so that the liquid does not escape except by the inlet port 102 and exit port 108 which are also formed by case.

The motor component 112 situated outside of the case, is not wetted by the liquid, and is fixed to the Case by attachments such as screws. A shaft of the motor 112 enters the case through a sealed hole.

The impeller 104 is contained within the case. The impeller 104 is wetted by the liquid. The impeller 104 is attached to shaft such that the motion of motor 112 is transferred to impeller 104 causing it to move. The movement of impeller 104 causes liquid to enter the inlet port and move toward the exit port. The movement of the liquid is directed from inlet to exit port by the geometry of case and impeller 104. The chiller/heater 106 is fixed to case by attachments such as screws. Chiller/Heater 106 penetrates the case such that one part of chiller/heater 106 is inside the case and is wetted by liquid while the other part of chiller/heater 106 is outside of the case and is dry. There is a seal around chiller/heater 106 so that liquid does not escape in the vicinity of the chiller/heater 106. Chiller/Heater 106 converts electron flow to thermal heat transfer by means of the Peltier effect. When electrons are made to flow in the positive direction, the wetted side of chiller/heater 106 is driven to lower temperatures and the dry side to higher temperature. The Peltier effect causes heat to flow from cold side to hot side and is reversible with a reversal in electron flow.

Example Process

Figure 4:
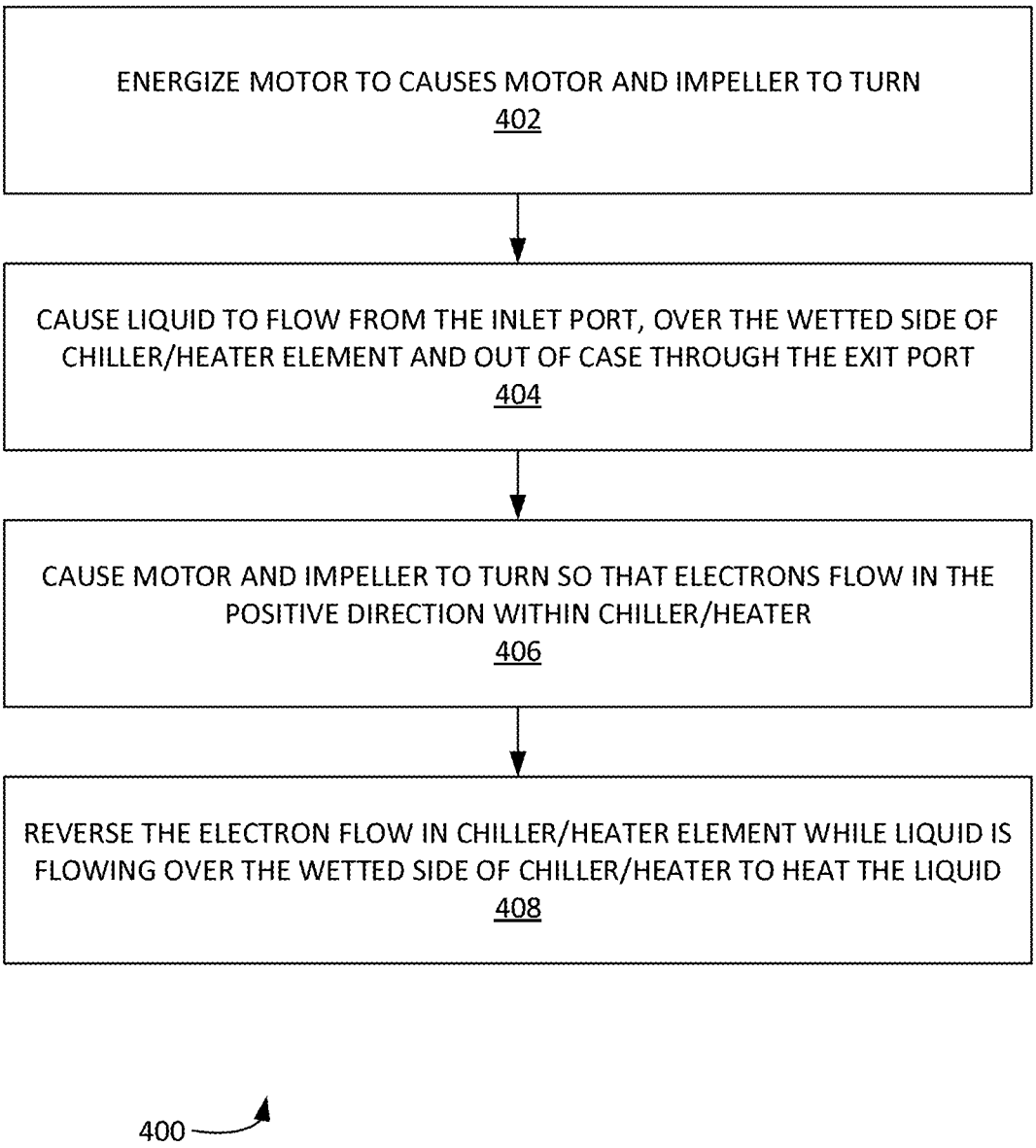
FIG. 4 illustrates an example process for implementing a thermo-electric cooler pump, according to some embodiments.

FIG. 4 illustrates an example process 400 for implementing a thermo-electric cooler pump system, according to some embodiments. In step 402, process 400 can energizing the motor of the thermo-electric cooler pump system. Energizing causes the motor and impeller to turn and, in turn, in step 404, causes a specified liquid to flow from the inlet port, over the wetted side of chiller/heater and out of case through the exit port. In step 406, process 400 energize heater and chiller so that electrons flow in the positive direction. When electrons are flowing in the positive direction the temperature of wetted side of heater and chiller will lower and the liquid flowing out of the exit port will be chilled. This can move electrons to flow in the positive direction within Chiller/Heater, while Motor and Impeller are turning, and results in heat removal from the liquid. The liquid leaving the exit port is thus at a lower temperature than the liquid entering case and the liquid is considered chilled. Optionally, in step 408, process 400 can reverse the electron flow in Heater and Chiller so that electrons flow in the negative direction. When electrons are flowing in the negative direction the temperature of Wetted Side of Heater and Chiller will raise and the liquid flowing out of the exit port will be heated.

CONCLUSION

Although the present embodiments have been described with reference to specific example embodiments, various modifications and changes can be made to these embodiments without departing from the broader spirit and scope of the various embodiments. For example, the various devices, modules, etc. described herein can be enabled and operated using hardware circuitry, firmware, software or any combination of hardware, firmware, and software (e.g., embodied in a machine-readable medium).

In addition, it can be appreciated that the various operations, processes, and methods disclosed herein can be embodied in a machine-readable medium and/or a machine accessible medium compatible with a data processing system (e.g., a computer system), and can be performed in any order (e.g., including using means for achieving the various operations). Accordingly, the specification and drawings are to be regarded in an illustrative rather than a restrictive sense. In some embodiments, the machine-readable medium can be a non-transitory form of machine-readable medium.

What is claimed is:

1. A thermo-electric cooler pump system comprising:

a case component, wherein the case component seals a liquid within the thermo-electric cooler pump system so that the liquid does not enter the thermo-electric cooler pump system except by an inlet port and escape the thermo-electric cooler pump system except by an exit port;

a motor component, wherein the motor component is situated outside of the case component, wherein the motor component is not wetted by the liquid, and wherein a shaft of the motor component enters the case through a sealed hole;

an impeller component, wherein the impeller component is contained within the case component, wherein the impeller component is wetted by the liquid, wherein the impeller component is attached to the shaft such that motion of the motor component is transferred to the impeller component causing it to move, and wherein a motion of the impeller component causes the liquid to enter the inlet port and flow toward the exit port; and a chiller/heater component, wherein the chiller/heater component is fixed to the case component, and wherein the chiller/heater component penetrates the case component such that a portion of the chiller/heater component is inside the case component and is wetted by the liquid while a different portion of chiller/heater component is outside of the case component and is dry, wherein there is a seal around the chiller/heater component so that liquid does not escape along a perimeter of the chiller/heater component, and wherein the chiller/heater component comprises an electron flow to facilitate a thermal heat transfer by means of the Peltier effect, wherein the flow of the liquid is directed from the inlet port to the exit port by a specified geometry of the case component and the impeller component, wherein when electrons are made to flow in a positive direction within the chiller/heater component, a wetted side of the chiller/heater component is driven to lower temperatures and a dry side to a higher temperatures, wherein when electrons are made to flow in a negative direction within the chiller/heater component, the wetted side of chiller/heater component is driven to higher temperatures and the dry side to the lower temperatures, wherein the wetted side of the chiller/heater component comprises a regularly-spaced plurality of parallel rows of elongated elements between which the liquid flows, wherein the plurality of rows of elongated elements are oriented perpendicular to both the flow of the liquid and the case component along the perimeter of the chiller/heater component, wherein the plurality of rows of elongated elements extend into the liquid from a single surface of the wetted side of the chiller/heater component, and wherein the wetted side of the chiller/heater component is in contact with the liquid, and wherein the dry side of the chiller/heater component comprises a plurality of parallel plates, and wherein the plurality of parallel plates are orthogonal in orientation to the plurality of rows of elongated elements and parallel to the flow of the liquid.

2. The thermo-electric cooler pump system of claim 1, wherein the inlet port is formed by the case component.

3. The thermo-electric cooler pump system of claim 2, wherein the exit port is formed by the case component.

4. A method of pumping a liquid with a thermo-electric cooler pump comprising:

providing a thermo-electric cooler pump, wherein the thermo-electric cooler pump comprises:

a case component, wherein the case component seals a liquid within the thermo-electric cooler pump system so that the liquid does not enter the thermo-electric cooler pump system except by an inlet port and escape the thermo-electric cooler pump system except by an exit port, a motor component, wherein the motor component is situated outside of the case component, wherein the motor component is not wetted by the liquid, and wherein a shaft of the motor component enters the case through a sealed hole, an impeller component, wherein the impeller component is contained within the case component, wherein the impeller component is wetted by the liquid, wherein the impeller component is attached to the shaft such that motion of the motor component is transferred to the impeller component causing it to move, and wherein a motion of the impeller component causes the liquid to enter the inlet port and flow toward the exit port, and a chiller/heater component, wherein the chiller/heater component is fixed to the case component, and wherein the chiller/heater component penetrates the case component such that a portion of the chiller/heater component is inside the case component and is wetted by the liquid while a different portion of chiller/heater component is outside of the case component and is dry, wherein there is a seal around the chiller/heater component so that liquid does not escape along a perimeter of the chiller/heater component, and wherein the chiller/heater component comprises an electron flow to facilitate a thermal heat transfer by means of the Peltier effect;

energizing the motor component, wherein energizing causes the motor component and the impeller component to turn;

causing the liquid to flow from the inlet port, over the wetted side of chiller/heater component and out of case through the exit port; and energizing the chiller/heater component so that electrons of the liquid flow in a positive direction to remove heat from the liquid, wherein the flow of the liquid is directed from the inlet port to the exit port by a specified geometry of the case component and the impeller component, wherein when electrons are made to flow in the positive direction within the chiller/heater component, a wetted side of the chiller/heater component is driven to lower temperatures and a dry side to a higher temperatures, wherein when electrons are made to flow in a negative direction within the chiller/heater component, the wetted side of chiller/heater component is driven to higher temperatures and the dry side to the lower temperatures, wherein the wetted side of the chiller/heater component comprises a regularly-spaced plurality of parallel rows of elongated elements between which the liquid flows, wherein the plurality of rows of elongated elements are oriented perpendicular to both the flow of the liquid and the case component along the perimeter of the chiller/heater component, wherein the plurality of rows of elongated elements extend into the liquid from a single surface of the wetted side of the chiller/heater component, and wherein the wetted side of the chiller/heater component is in contact with the liquid, and wherein the dry side of the chiller/heater component comprises a plurality of parallel plates, and wherein the plurality of parallel plates are orthogonal in orientation to the plurality of rows of elongated elements and parallel to the flow of the liquid.

* * * * *